United States Patent [19]

Ford

[11] 4,414,088

[45] Nov. 8, 1983

[54] CHLORATE CELL SYSTEM

[75] Inventor: Joseph B. Ford, Oakville, Canada

[73] Assignee: ERCO Industries Limited, Islington, Canada

[21] Appl. No.: 304,108

[22] Filed: Sep. 21, 1981

[51] Int. Cl.[3] ..... C25B 15/08; C25B 9/00; C25B 11/10; C25B 1/24

[52] U.S. Cl. ..... 204/237; 204/95; 204/268; 204/270; 204/290 F; 204/279; 204/288; 204/289; 428/660; 428/677

[58] Field of Search ..... 204/267–269, 204/270, 279, 290 R, 290 F, 288–289, 237, 95; 428/660, 674, 677, 940

[56] References Cited

U.S. PATENT DOCUMENTS

| | | | |
|---|---|---|---|
| 3,539,486 | 11/1970 | Fleck | 204/237 X |
| 3,785,951 | 1/1974 | Fleck | 204/269 X |
| 3,884,792 | 5/1975 | McGilvery | 204/268 X |
| 4,116,805 | 9/1978 | Ichisaka et al. | 204/290 F |
| 4,116,807 | 9/1978 | Peters | 204/290 F |
| 4,194,953 | 3/1980 | Hatherly | 204/269 X |

*Primary Examiner*—Donald R. Valentine

*Attorney, Agent, or Firm*—Sim & Mcburney

[57] ABSTRACT

A novel electrolysis unit (10) for forming sodium chlorate from sodium chloride utilizes a reaction tank (12) and a bank (18) of electrolysis cells wherein the cells (20) are rigidly joined together using a bipolar cell divider plate (42) between adjacent cells. The cells (20) contain interleaved anode (34) and cathode (32) plates which define upwardly-extending electrolysis channels (36). The bank of cells (18) is connected to the reaction tank (18) to receive a plurality of individual flows of electrolyte to the cells (24) and to forward a plurality of individual flows of electrolyzed material (26) to the tank (12). The cell divider plate (42) comprises anodic (64) and cathodic (62) metal layers intimately and integrally connected, by explosive bonding to an electrically-conducting metal layer (66), usually copper.

4 Claims, 6 Drawing Figures

CHLORATE CELL SYSTEM

FIELD OF INVENTION

The present invention relates to a chlorate cell.

BACKGROUND TO THE INVENTION

In prior U.S. Pat. No. 4,194,953 to David G. Hatherly and assigned to the assignee of this application, there is described an electrolysis unit for the production of sodium chlorate or other halates by electrolysis of sodium chloride solution or other halide, which comprises a plurality of individual electrolysis cells connected in parallel to a reaction tank. The individual electrolysis cells are self-contained electrolysis zones which are connected in series electrically by flexible electrical connectors. A plurality of such electrolysis units is used in a chlorate plant, with brine solution being fed in parallel streams from a single source to the electrolysis units and sodium chlorate solution being removed in parallel streams from the electrolysis units to form a single sodium chlorate product stream.

The system which is described in this prior patent operates effectively but the utilization of physically-separate flexible connector-interconnected electrolysis cells results in a large building area requirement.

SUMMARY OF INVENTION

In order to overcome this prior art difficulty, the electrolysis cells are rigidly joined in this invention, in a bank of cells having specifically-constructed bipolar electrodes separating the cells in the bank.

By interconnecting the cells in a bank in accordance with this invention, the area occupied by the electrolysis unit may be considerably diminished and the size of building required to house the plant may be decreased by about 40 to 50% for the same overall plant capacity, thereby realizing a considerable saving in overall capital construction cost.

In addition, the construction provided by the invention decreases power losses resulting from the use of the interconnecting cables and hence the overall operating cost of a chlorate plant may be decreased.

DESCRIPTION OF PREFERRED EMBODIMENT

Figure 1:
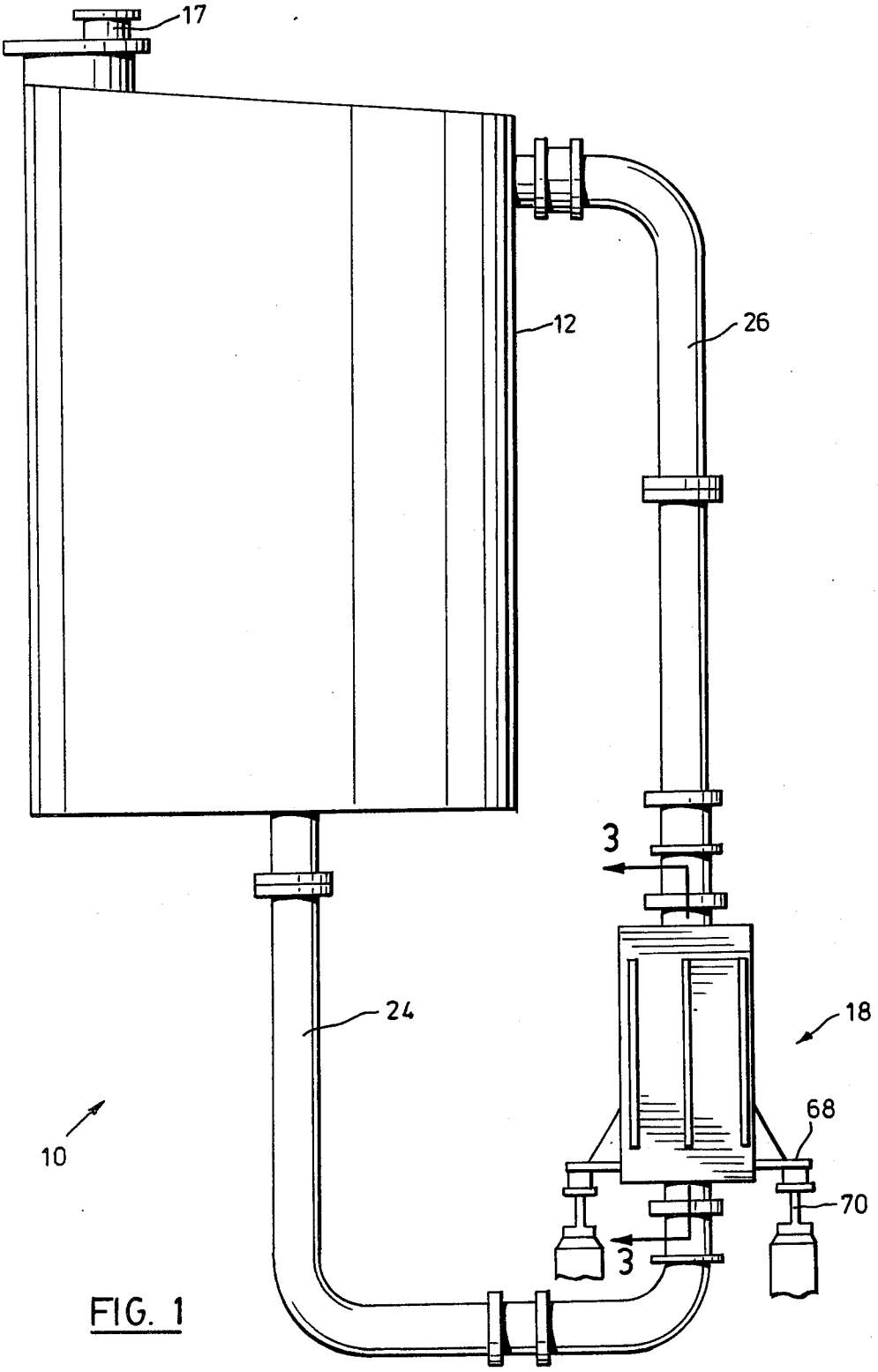
FIG. 1 is a side elevational view of an electrolysis unit constructed in accordance with this invention.
Figure 2:
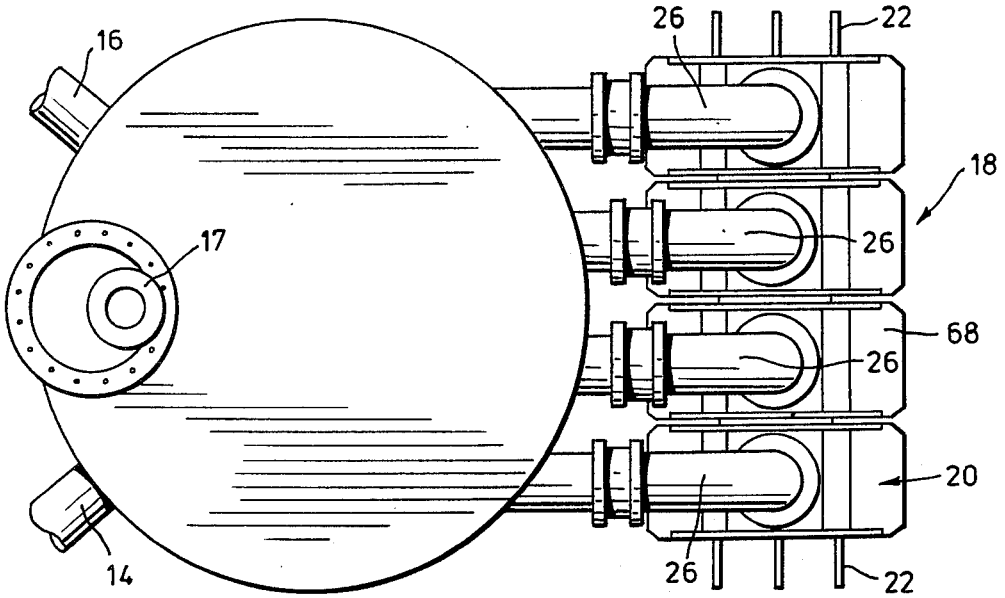
FIG. 2 is a plan view of the electrolysis unit of FIG. 1.

Referring to the drawings, which illustrate the current best mode of carrying out the invention known to the applicants, an electrolysis unit 10 suitable for joining in parallel flow manner with other similar electrolysis units in a sodium chlorate plant as described in U.S. Pat. No. 4,194,953.

The electrolysis unit 10 comprises a cylindrical reaction tank 12 having an inlet pipe 14 for feed of fresh brine for electrolysis, an outlet pipe 16 for removal of sodium chlorate solution therefrom and an outlet pipe 17 for venting gases, mainly in the form of hydrogen, from the reaction tank 12. The cylindrical reaction tank 12 communicates with a bank 18 of individual electrolysis cells 20 for effecting electrolysis of the brine solution in the cells 20. The electrolysis cells 20 are rigidly joined together in a manner described in detail below and the end members of the bank 18 have electrical connectors 22 for the application of electrical power through the individual cells 20 of the bank 18.

Individual conduits 24 (only one is shown in FIG. 1) connect the lower end of the reaction tank 12 with the lower end of each of the electrolysis cells 20 for feed of liquor to be electrolyzed from the tank 12 to the bank of cells 18. Individual conduits 26 connect the upper end of each of the electrolysis cells 20 to the reaction tank 12 for feed of electrolyzed liquor from the bank of cells 18 to the reaction tank 12.

Figure 5:
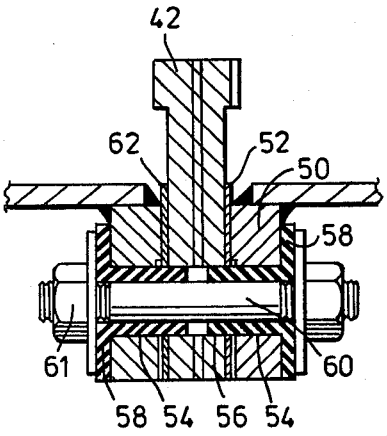
FIG. 5 is a detail taken at circle 5 in FIG. 3 showing the manner of interconnection of the cells.
Figure 6:
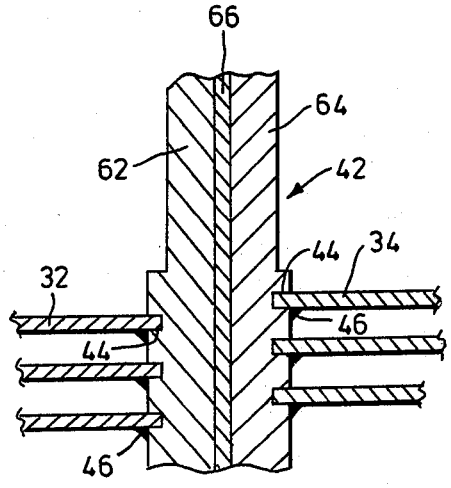
FIG. 6 is a detail taken at circle 6 of FIG. 4 showing the construction of the bipolar electrodes separating the cells.
Figure 3:
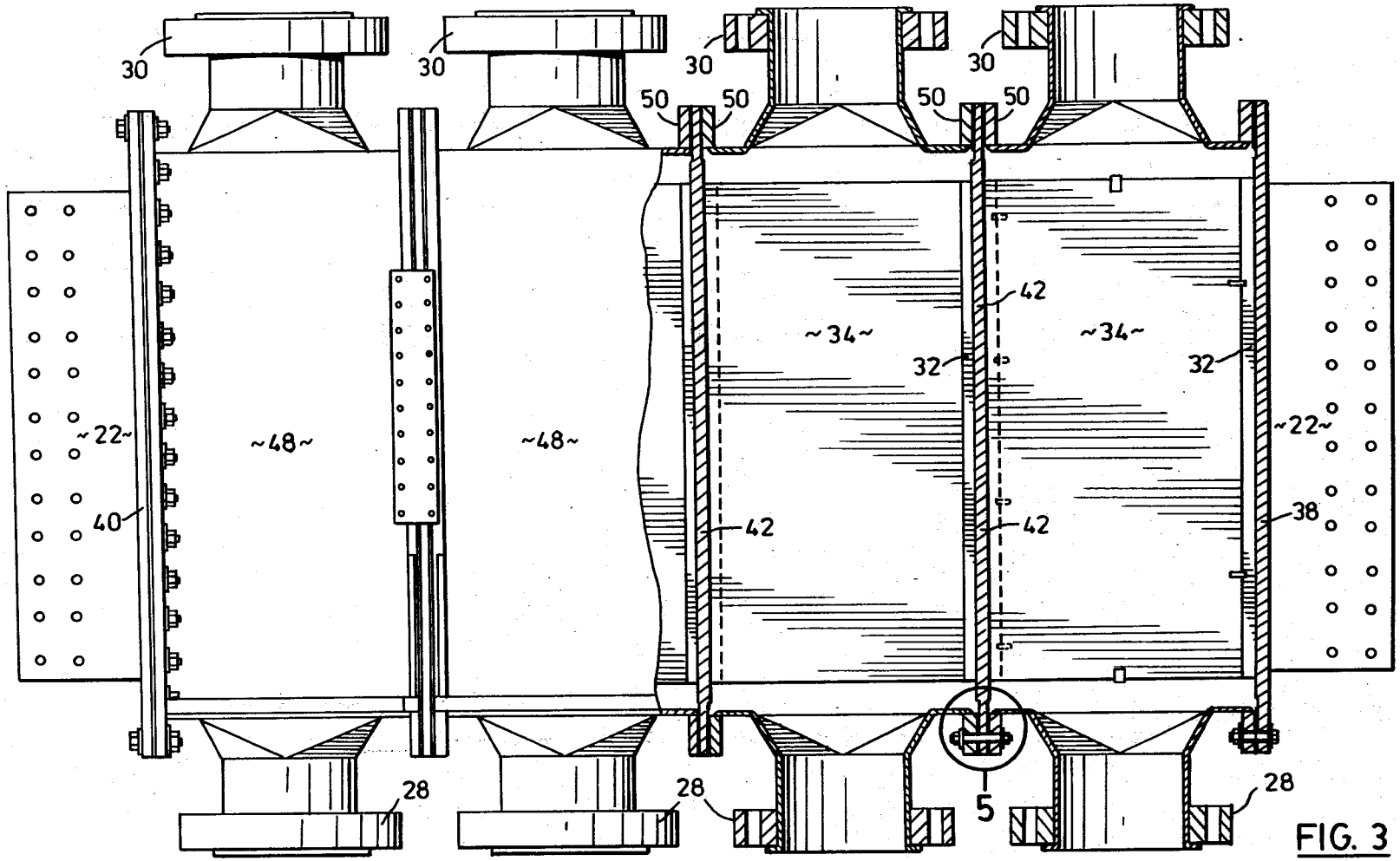
FIG. 3 is a front elevational view, partly in section, of a bank of electrolysis cells used in the electrolysis unit of FIG. 1 and taken on line 3—3 of FIG. 1.
Figure 4:
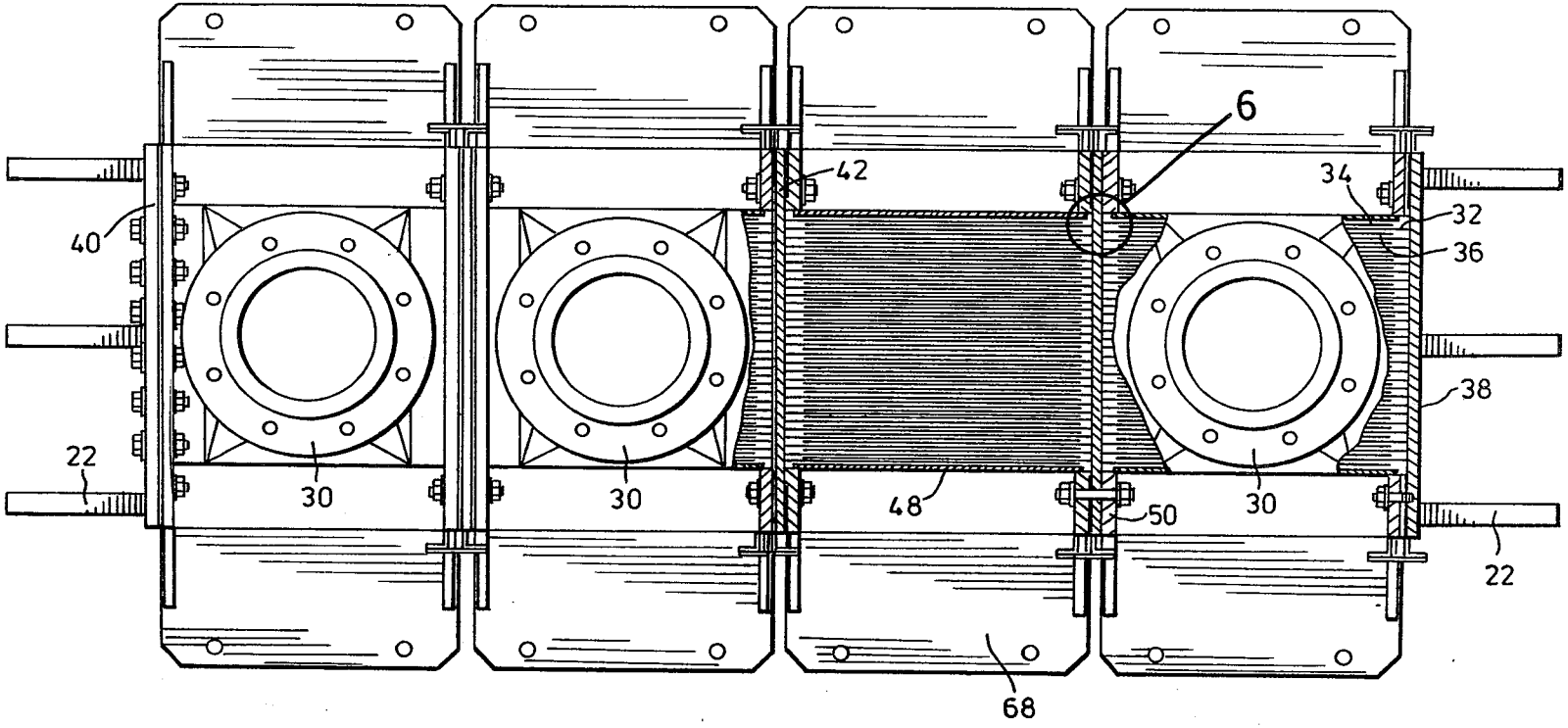
FIG. 4 is a plan view, partly in section, of the bank of electrolysis cells of FIG. 3.

The bank of cells 18 is illustrated more fully in FIGS. 4 to 6. The individual cells 20 each has a box-like structure and includes a lower liquid inlet manifold 28 and an upper liquid outlet manifold 30. Extending from a cathodic side wall in parallel upright manner are a plurality of thin metal cathode plates 32, preferably constructed of steel, which interleave with a plurality of thin metal anode plates 34, preferably constructed of titanium coated with a conductive metal, alloy or oxide, usually including a platinum group metal, alloy or oxide. The interleaved cathode and anode plates define a plurality of vertically-extending electrolysis channels 36 through which flows liquor to be electrolyzed from the inlet manifold 28 to the outlet manifold 30.

At one end of the bank 18, the cathode plates 32 extend from a cathode end plate 38 while, at the other end of the bank 18, the anode plates 34 extend from an anode end plate 40. A bipolar divider plate 42 separates the individual cells 20 from each other. Anode plates 34 extend from one side of the bipolar plate 32 into interleaved relationship with the cathode plates 42 of the cell 20 into which those anode plates extend. Cathode plates 32 extend from the other side of the bipolar plate 42 into interleaved relationship with the anode plates 34 of the cell 20 into which those cathode plates extend.

The anode plates 34 and the cathode plates 32 may be mounted to the bipolar divider plate 42 in any convenient manner. The connection is preferably effected in the manner illustrated in the detail view of FIG. 6, namely, by providing electrode plate-receiving grooves 44 in the surfaces of the divider plate 42, insertion of the electrode plates 32, 34 into the grooves 44 and welding the electrode plates 32, 34 into place by tack welds 46.

The divider plate 42 is sandwiched between the cells 20 but is electrically insulated from steel side walls 48 and the inlet and outlet manifolds 28 and 30 of each cell 20, as may be seen from the detail view of FIG. 5. FIG. 5 shows a detail of the manner of join at the inlet manifold 28 and the construction thereat is repeated along each side and at the top of the cell 20. Outwardly directed flanges 50 extend around the whole of the perimeter of the cell 20 at the extremities of the end walls 48 and the inlet and outlet manifolds 28 and 30. The flanges 50 of adjacent cells 20 abut insulating gaskets 52 which engage the plate 42. Aligned openings 54 in the flanges 50 and 56 in the plate 42 receive insulating sleeves 58 therein. A bolt 60 is received through the openings and is tightened by nuts 61 to rigidly connect the parts together with the divider 42 plate sandwiched between the flanges 50.

The bipolar divider plate 42 is formed of multiple metal layers, comprising an iron or steel layer 62 on the cathodic side of the plate 42, a titanium layer 64 on the anodic side of the plate 42 and a copper connecting layer 66 electrically connecting the cathode and anode layers. The layers 62, 64 and 66 may be joined together in any convenient manner, preferably by explosive bonding of the thin copper layer to the titanium layer and to the steel layer since an excellent bond exhibiting little electrical resistance is achieved thereby.

If desired, titanium may be replaced by tantalum, tungsten or other valve metal. The titanium metal sheet 64 may be provided with an electroconductive surface, if desired, to increase the overall anode surface area of the individual cells 20. Usually, the material providing the electroconductive surface on the titanium metal sheet is the same material as provides the electroconductive material on the anode plates 34.

The bank 18 of the individual cells 20 may be supported in any convenient manner. As illustrated (see FIG. 1), the individual cells 20 have outwardly-directed flanges 68 which are supported on rails 70.

The electrolysis unit 10, therefore, includes a cylindrical reaction tank 12 which communicates with a bank 18 of cells in which the individual cells 20 are rigidly connected together in a compact manner and separated by uniquely constructed bipolar cell dividers. The elimination of the flexible connectors required in the prior structure enables much less floor space to be utilized for the same plant capacity, thereby decreasing significantly the capital cost of the plant. In addition, power requirements are decreased, since power losses associated with the use of the flexible connectors are decreased, thereby decreasing the operating costs of the plant.

The electrolysis unit 10 has been described having a bank of four individual cells 20. This number is illustrated since this is a convenient number of cells from the points of view of ease of construction and avoiding corrosion. Any desired number may be used, if desired, but large numbers generally are avoided since the changes of corrosion increase significantly.

SUMMARY OF DISCLOSURE

In summary of this disclosure, the present invention provides a novel electrolysis unit useful in the formation of sodium chlorate. Modifications are possible within the scope of this invention.

What I claim is:

1. An electrolysis unit for the production of sodium chlorate by electrolysis of sodium chloride solution, which comprises:

a single reaction tank having a liquid feed inlet for receiving sodium chloride solution in said tank and a liquid product outlet for removing sodium chlorate product solution from said tank, a plurality of electrolysis cells connected in electrical series one with another in a bank wherein the cells are physically joined together in substantially fixed position relative to one another, each of said plurality of cells having a plurality of anode and cathode electrodes located therein and extending from respective spaced apart parallel anode and cathode backing plates in interleaved manner to define upwardly-directed parallel electrolysis channels therebetween extending between a lower inlet and an upper outlet, said cathode electrodes and cathode backing plates being constructed of mild steel, said anode electrodes being constructed of titanium having an electroconductive surface and said anode backing plate being constructed of titanium, said bank of cells having an anode backing plate located at one end and a cathode backing plate located at the other end, said bank of cells further having a cell divider plate located between each adjacent pair of cells in said bank to isolate the cells one from another, said cell divider plate consisting of the cathode backing plate of one cell and the anode backing plate of another cell intimately and integrally explosively bonded to opposite sides of a copper plate, said anode backing plate, cathode backing plate and copper plate being coextensive with each other, said cell divider plate being rigidly connected to but electrically insulated from structural parts of adjacent cells in said bank, a plurality of first liquid feed conduits corresponding in number with the number of said plurality of cells in said bank extending between respective liquid outlets of said reaction tank and respective ones of said liquid inlets to said cells, and a plurality of second liquid feed conduits corresponding in number with the number of said plurality of cells in said bank extending between respective liquid outlets of said cells and respective liquid inlets to said reaction tank.

2. The electrolysis unit of claim 1 wherein each of said cells has an integral frame which includes said upper and lower outlets, parallel mild steel side walls and open ends, said integral frame has integral flange members surrounding said open end, said cell divider plate is sandwiched between and bolted to the flange members of adjacent cells in the bank in non-electrically-conducting relationship, said anode backing plate is bolted to the flange member at the anodic open end of the bank in non-electrically-conducting relationship, and said cathode backing plate is bolted to the flange member at the cathodic open end of the bank.

3. The electrolysis unit of claim 1 wherein said reaction tank is right cylindrical with the axis extending vertically.

4. A cell divider plate for dividing individual electrically series-connected electrolyte parallel-connected cells joined in a bank, which consists essentially of:

a planar central copper layer, an outer planar titanium layer coextensive with and explosively bonded to one face of said central copper layer, and an outer planar mild steel layer coextensive with and explosively bonded to the other face of said central copper layer, a plurality of parallel thin cathode electrode sheets constructed of mild steel being welded in respective parallel grooves formed in said mild steel layer and extending away from said mild steel layer, a plurality of parallel thin anode electrode sheets constructed of titanium and having an electroconductive surface thereon being welded in respective parallel grooves formed in said titanium layer and extending away from the titanium layer in the opposite direction to the direction of extension of said cathode sheets.

* * * * *